US009849952B2

(12) United States Patent
Wung

(10) Patent No.: US 9,849,952 B2
(45) Date of Patent: Dec. 26, 2017

(54) SNORKEL UPPER DISCHARGING HEAD HAVING WATERPROOF DEVICE

(75) Inventor: Chin Hsien Wung, Dongguan (CN)

(73) Assignee: DONGGUAN LONGWELL SPORTS CO., LTD, Dongguan, Guangdong Province (CN)

( * ) Notice: Subject to any disclaimer, the term of this patent is extended or adjusted under 35 U.S.C. 154(b) by 964 days.

(21) Appl. No.: 13/354,491

(22) Filed: Jan. 20, 2012

(65) Prior Publication Data

US 2013/0160762 A1 Jun. 27, 2013

(30) Foreign Application Priority Data

Dec. 26, 2011 (CN) ..... 2011 2 0550644 U

(51) Int. Cl.
*B63C 11/20* (2006.01)
*B63C 11/16* (2006.01)
*B63C 11/18* (2006.01)

(52) U.S. Cl.
CPC ..... *B63C 11/205* (2013.01); *B63C 11/16* (2013.01); *B63C 11/186* (2013.01); *B63C 11/207* (2013.01)

(58) Field of Classification Search
CPC ..... B63C 11/207; B63C 11/205; B63C 11/16; B63C 11/186
USPC ..... 128/201.11, 201.27, 200.29, 200.24, 128/200.26, 201.26; 405/185, 186, 187
See application file for complete search history.

(56) References Cited

U.S. PATENT DOCUMENTS

| | | | | |
|---|---|---|---|---|
| 7,708,012 | B2 * | 5/2010 | Shiue | 128/201.11 |
| 2007/0267012 | A1 * | 11/2007 | McCarthy | 128/201.11 |
| 2007/0267067 | A1 * | 11/2007 | Pan | 137/433 |

* cited by examiner

*Primary Examiner* — Todd J Scherbel
*Assistant Examiner* — Elliot S Ruddie
(74) *Attorney, Agent, or Firm* — Ming Chow; Sinorica, LLC

(57) ABSTRACT

A snorkel upper discharging head has a waterproof device. The snorkel upper discharging head comprises a snorkel upper discharging head body and a floating drum, an air inlet hole is arranged at the front end of the snorkel upper discharging head body and is sleeved with a sealing ring, the snorkel upper discharging head body is internally provided with an air duct communicated with the air inlet hole, circular arc sliding slots are arranged at the left and right inner sides of the snorkel upper discharging head body, the floating drum is clamped in the circular arc sliding slots, and a water seal face jointed with the sealing ring is arranged in the middle of the floating drum; the snorkel upper discharging head having the waterproof device not only has simple and compact structure and excellent waterproof effect, but is also eye-pleasing and fashionable in appearance.

7 Claims, 5 Drawing Sheets

SNORKEL UPPER DISCHARGING HEAD HAVING WATERPROOF DEVICE

TECHNICAL FIELD

The present invention relates to the technical field of snorkel of diving equipment, in particular to a snorkel upper discharging head having a waterproof device.

BACKGROUND OF THE INVENTION

Snorkel is a tool commonly used in swimming or diving activities, a vent at the upper end of the snorkel is positioned above water surface when a user does an activity on water surface or underwater so as to keep the user breathing. The snorkel equipped with a waterproof device, in addition to preventing water from splashing in the snorkel, can automatically close the vent at the upper end thereof when being totally immersed in water so as to prevent water from entering the snorkel and further flowing into the mouth of user, thus unsmooth breath is avoided.

While the snorkel in the prior art has a waterproof device, the waterproof is structurally complex, causing plenty of conveniences to the production and assembly in company, in addition, the reliability in use is not high, the waterproof effect is unsatisfactory, and the overall appearance is not eye-pleasing enough.

SUMMARY OF THE INVENTION

The present invention provides a snorkel upper discharging head body having a waterproof device, which not only has simple and compact structure and excellent waterproof effect, but is also eye-pleasing and fashionable in appearance.

In order to solve the technical problem above, the present invention discloses a snorkel upper discharging head having a waterproof device. The snorkel upper discharging head comprises a snorkel upper discharging head body and a floating drum, an air inlet hole is arranged at the front end of the snorkel upper discharging head body and is sleeved with a sealing ring, the snorkel upper discharging head body is internally provided with an air duct communicated with the air inlet hole, circular arc sliding slots are arranged at the left and right inner sides of the snorkel upper discharging head body, the floating drum is clamped in the circular arc sliding slots, and a water seal face jointed with the sealing ring is arranged in the middle of the floating drum.

Wherein, small air inlet holes are designed at two sides of the upper end of the floating drum in the vicinity of the water seal face.

Wherein, the floating drum consists of a floating drum left cover and a floating drum right cover by means of ultrasonic welding Wherein, the floating drum left cover and the floating drum right cover are provided with sliding slot guide pillars, respectively.

Wherein, the floating drum left cover, the floating drum right cover and the water seal face form a sealed space.

Wherein, the snorkel upper discharging head body consists of a snorkel upper discharging head body left cover and a snorkel upper discharging head body right cover by means of ultrasonic welding.

Wherein, the sealing ring is higher than the outer end face of the air inlet hole.

Wherein, one end of the sealing ring, which is higher than the outer end face of the air inlet hole, is provided with a chamfer.

Wherein, a front undercut is arranged at the front end of the snorkel upper discharging head body, a rear undercut is arranged at the front end of the floating drum, and the front undercut is in tight fit with the rear undercut.

The present invention has the advantages that: a snorkel upper discharging head having waterproof device comprises a snorkel upper discharging head body and a floating drum, an air inlet hole is arranged at the front end of the snorkel upper discharging head body and is sleeved with a sealing ring, the snorkel upper discharging head body is internally provided with an air duct communicated with the air inlet hole, circular arc sliding slots are arranged at the left and right inner sides of the snorkel upper discharging head body, the floating drum is clamped in the circular arc sliding slots, and a water seal face jointed with the sealing ring is arranged in the middle of the floating drum; the snorkel upper discharging head having the waterproof device not only has simple and compact structure and excellent waterproof effect, but is also eye-pleasing and fashionable in appearance.

DETAILED DESCRIPTION OF THE EMBODIMENTS

Detailed description is made below to the present invention with reference to the drawings.

Figure 1:
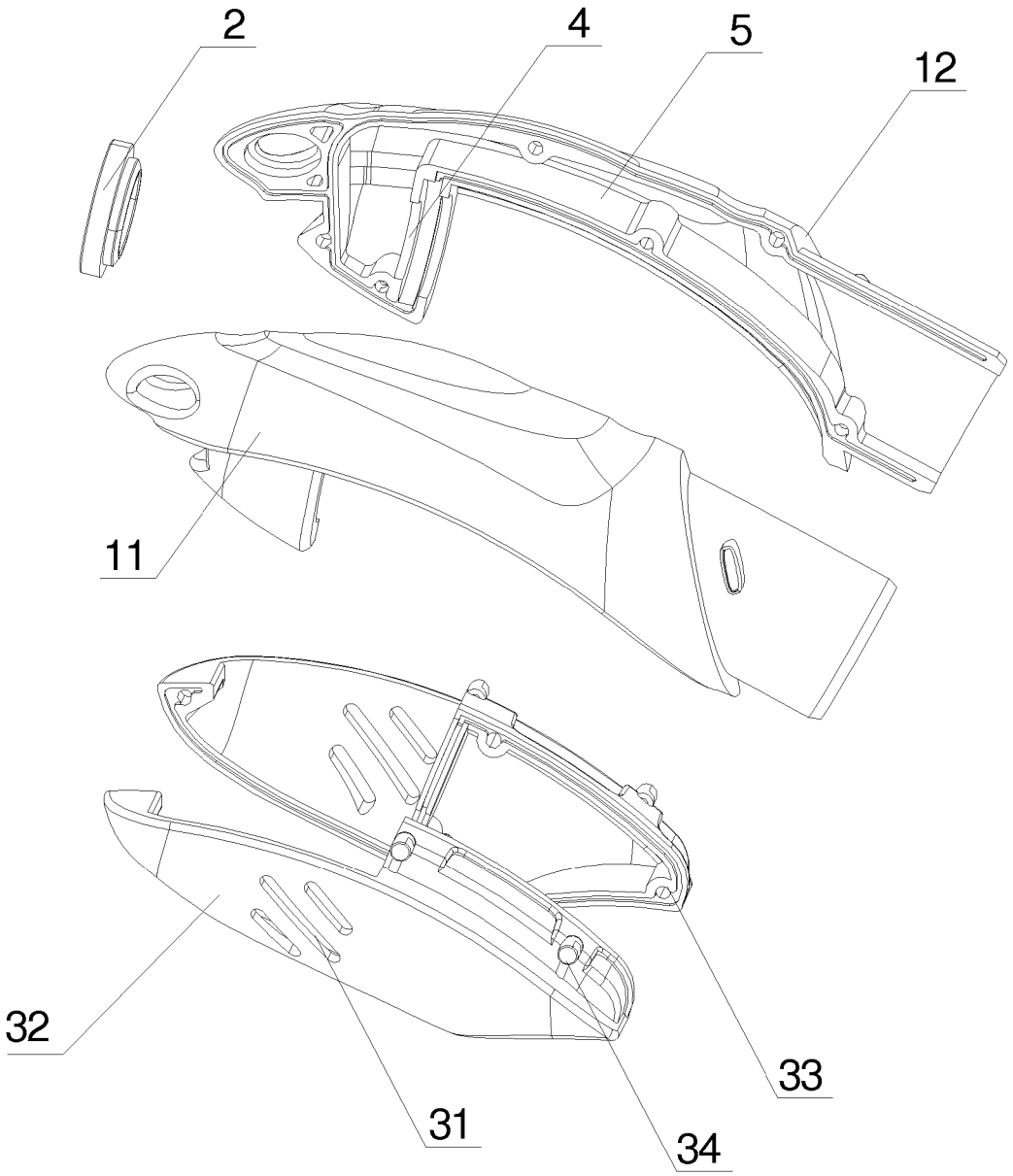
FIG. 1 is an exploded schematic diagram of the present invention.
Figure 2:
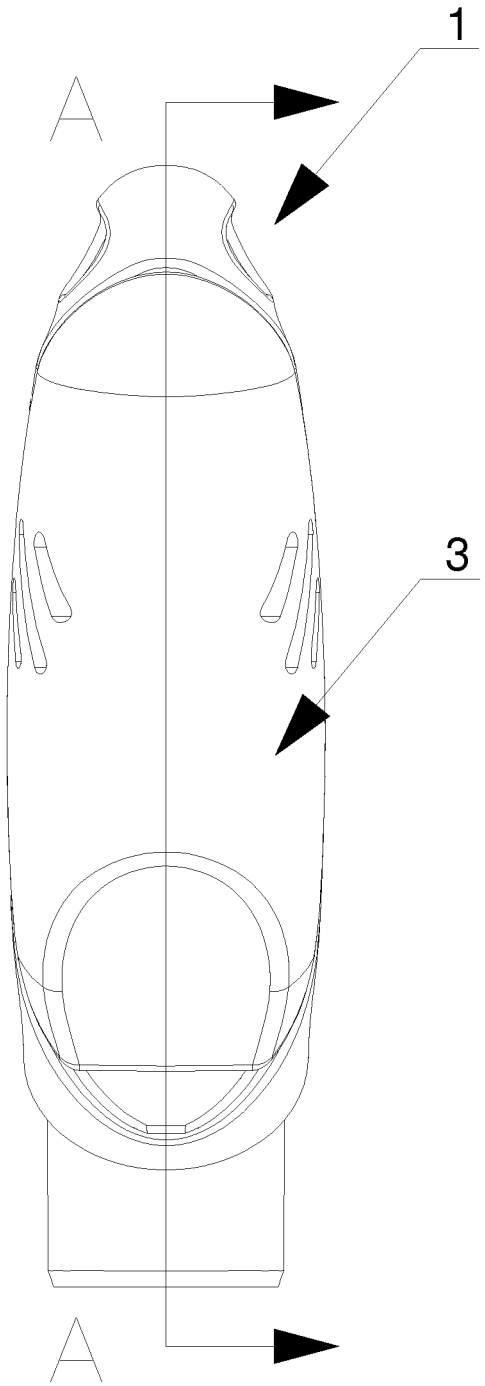
FIG. 2 is a structural schematic diagram of the present invention.
Figure 3:
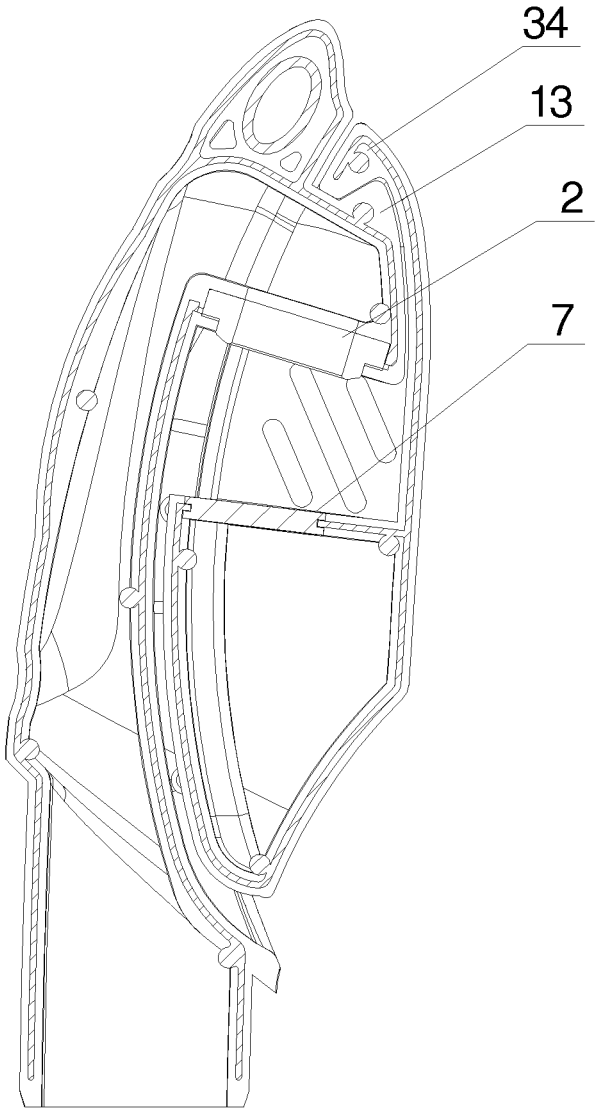
FIG. 3 is a sectional view of FIG. 2 along the section line at A-A.
Figure 4:
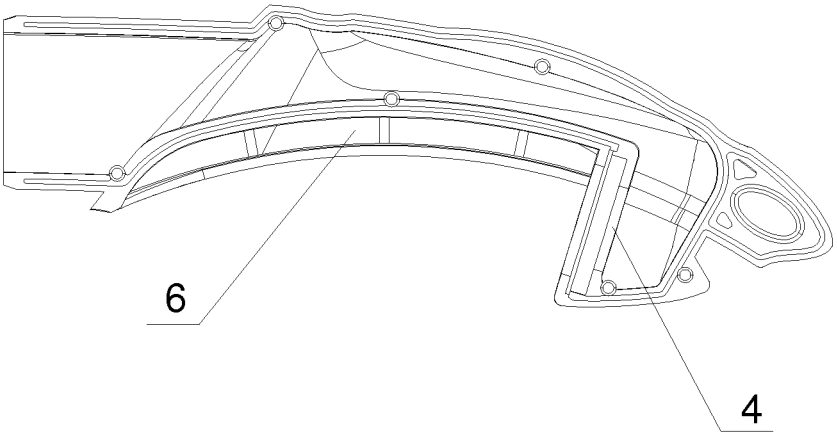
FIG. 4 is a structural schematic diagram of the snorkel upper discharging head body left cover of the present invention.
Figure 5:
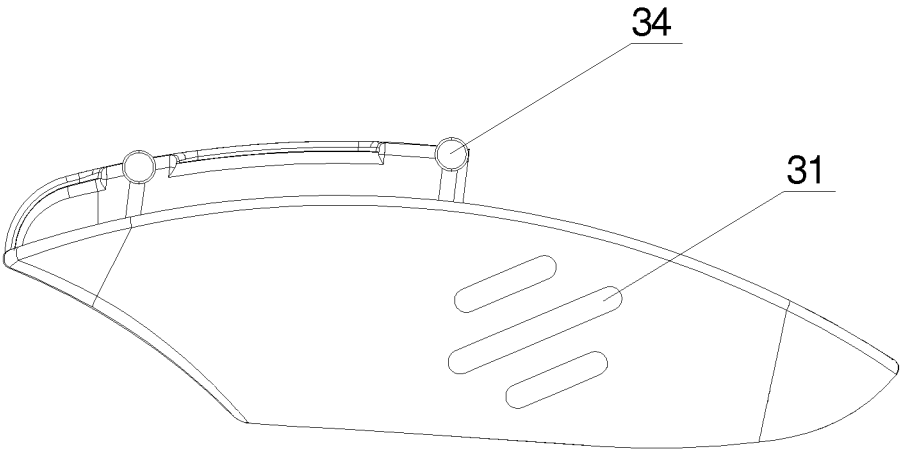
FIG. 5 is a structural schematic diagram of the floating drum right cover of the present invention.
Figure 6:
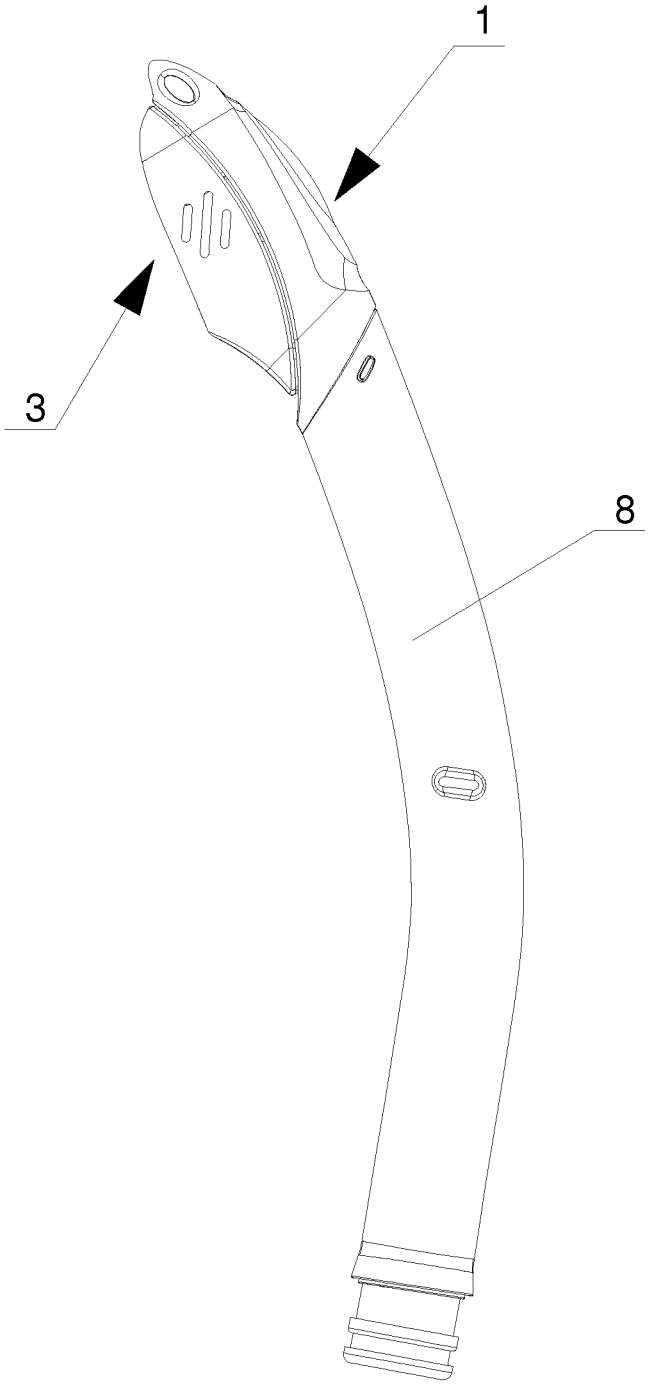
FIG. 6 is another structural schematic diagram of the present invention.

Shown as FIG. 1 to FIG. 6, the snorkel upper discharging head having the waterproof device in the present invention comprises a snorkel upper discharging head body 1 and a floating drum 3, an air inlet hole 4 is arranged at the front end of the snorkel upper discharging head body 1 and is sleeved with a sealing ring 2, the snorkel upper discharging head body 1 is internally provided with an air duct 5 communicated with the air inlet hole 4, circular arc sliding slots 6 are arranged at the left and right inner sides of the snorkel upper discharging head body 1, the floating drum 3 is clamped in the circular arc sliding slots 6, and a water seal face 7 jointed with the sealing ring 2 is arranged in the middle of the floating drum 3; small air inlet holes 31 are designed at two sides of the upper end of the floating drum 3 in the vicinity of the water seal face 7; the floating drum 3 consists of a floating drum left cover 32 and a floating drum right cover 33 by means of ultrasonic welding; the floating drum left cover 32 and the floating drum right cover 33 are provided with sliding slot guide pillars 34, respectively; the floating drum left cover 32, the floating drum right cover 33 and the water seal face 7 form a sealed space; the snorkel upper discharging head body 1 consists of a snorkel upper discharging head body left cover 11 and a snorkel upper discharging head body right cover 12 by means of ultrasonic welding; the sealing ring 2 is higher than the outer end face of the air inlet hole 4; one end of the sealing ring 2, which is higher than the outer end face of the air inlet hole 4, is provided with a chamfer; a front undercut 13 is arranged at the front end of the snorkel upper discharging head body 1, a rear undercut 34 is arranged at the front end of the floating drum 3, and the front undercut 13 is in tight fit with the rear undercut 34.

When a user uses the snorkel for diving, the lower end of the snorkel is immersed in water at first, the floating drum 3 is positioned at an original jointing position under the action of gravity before the floating drum comes into contact with water surface, the front undercut 13 at the front end of the air inlet hole 4 is in tight fit with the rear undercut 34 at the front end of the floating drum 3, the air duct 5 and the air inlet hole 4 are communicated with the air outside through the small air inlet holes 31, thus the user can freely take the air outside into lung by means of the breathing pipeline 8; when the user continues diving downwards, the floating drum 3 generates a certain buoyancy in water since the floating drum left cover 32, the floating drum right cover 33 and the water seal face 7 form a sealed space, and while the user continues diving downwards, the floating drum 3 drives the sliding slot guide pillars 34 under the action of the buoyancy to slide upwards along the circular arc sliding slots 6 inside the snorkel upper discharging head body 1, thus the water seal face 7 is driven to get close to the sealing ring 2, and when the user dives to a certain depth, the water seal ring 7 is completely jointed with the sealing ring 2 before the air inlet hole 4 is under water surface, thus avoiding the situation that liquid enters the mouth of the user through the air inlet hole 4 to affect breath negatively after the air inlet hole 4 is under water surface. Because the sealing ring 2 is higher than the outer end face of the air inlet hole 4 and is provided with the chamfer, more sufficient jointing between the water seal face 7 and the sealing ring 2 is realized and better sealing effect is obtained; similarly, when the user floats upwards, the floating drum 3 descends under the action of gravity as the water surface descends, until the front undercut 13 at the front end of the snorkel upper discharging head body 1 is jointed with the rear undercut 34 at the front end of the floating drum 3; the user can take the air outside into lung through the small air inlet hole 31 only if the water seal face 7 is disengaged from the sealing ring 2, so the snorkel upper discharging head having the waterproof device not only has simple and compact structure and excellent waterproof effect, but is also eye-pleasing and fashionable in appearance.

The snorkel upper discharging head body 1 consists of a snorkel upper discharging head body left cover 11 and a snorkel upper discharging head body right cover 12 by means of ultrasonic welding, and similarly, the floating drum 3 consists of a floating drum left cover 32 and a floating drum right cover 33 by means of ultrasonic welding, thus greatly facilitating the production and assembly in company, saving the manufacturing cost and making the product more competitive on the market.

The floating drum left cover 32 and the floating drum right cover 33 of the floating drum 3 can be manufactured in a profile consistent with that of the snorkel upper discharging head body 1, as a result, the overall appearance of the snorkel looks extremely eye-pleasing and fashionable.

The disclosure above is merely preferred embodiments of the present invention, modifications to the implementations and the scope can be made by ordinary skilled in this art in accordance with the spirit of the present invention, and the disclosure in the specification shall not be contemplated as being limitative to the present invention.

What is claimed is:

1. A snorkel upper discharging head having a waterproof device, comprising:

a snorkel upper discharging head body (1);

a floating drum (3);

an air inlet hole (4);

the air inlet hole (4) being arranged at a front end of the snorkel upper discharging head body (1);

a sealing ring (2);

the air inlet hole (4) being sleeved with the sealing ring (2);

an air duct (5);

the snorkel upper discharging head body (1) being internally provided with the air duct (5);

the air duct (5) being in communication with the air inlet hole (4);

circular arc sliding slots (6);

the circular arc sliding slots (6) being arranged at left and right inner sides of the snorkel upper discharging head body (1);

the floating drum (3) being clamped in the circular arc sliding slots (6);

a water seal face (7);

the water seal face (7) being joined to the sealing ring (2);

the water seal face (7) being arranged in a middle of the floating drum (3);

small air inlet holes (31);

the small air inlet holes (31) disposed on two sides of an upper end of the floating drum (3) in the vicinity of the water seal face (7); and the floating drum (3) comprising a floating drum left cover (32) and a floating drum right cover (33) bonded to each other by means of ultrasonic welding.

2. The snorkel upper discharging head having a waterproof device according to claim 1, wherein the floating drum left cover (32) and the floating drum right cover (33) are provided with sliding slot guide pillars (34), respectively.

3. The snorkel upper discharging head having a waterproof device according to claim 2, wherein the floating drum left cover (32), the floating drum right cover (33) and the water seal face (7) form a sealed space.

4. The snorkel upper discharging head having a waterproof device according to claim 1, wherein the snorkel upper discharging head body (1) consists of a snorkel upper discharging head body left cover (11) and a snorkel upper discharging head body right cover (12) bonded to each other by means of ultrasonic welding.

5. The snorkel upper discharging head having a waterproof device according to claim 1, wherein the sealing ring (2) is higher than the outer end face of the air inlet hole (4).

6. The snorkel upper discharging head having a waterproof device according to claim 5, wherein one end of the sealing ring (2), which is higher than the outer end face of the air inlet hole (4), is provided with a chamfer.

7. The snorkel upper discharging head having a waterproof device according to claim 5, wherein a front undercut (13) is arranged at the front end of the snorkel upper discharging head body (1), a rear undercut (34) is arranged at the front end of the floating drum (3), and the front undercut (13) is in tight fit with the rear undercut (34).

* * * * *